US005873483A

United States Patent [19]

Görtz et al.

[11] Patent Number: 5,873,483

[45] Date of Patent: Feb. 23, 1999

[54] RESEALABLE CONTAINER

[75] Inventors: Hans Görtz, Nyhamnsläge; Thomas Andersson, Mörarp, both of Sweden

[73] Assignee: Regath HB, Helsingborg, Sweden

[21] Appl. No.: 849,105

[22] PCT Filed: Dec. 12, 1995

[86] PCT No.: PCT/SE95/01492

§ 371 Date: Jun. 9, 1997

§ 102(e) Date: Jun. 9, 1997

[87] PCT Pub. No.: WO96/18555

PCT Pub. Date: Jun. 20, 1996

[30] Foreign Application Priority Data

Dec. 13, 1994 [SE] Sweden ..... 9404329

[51] Int. Cl.[6] ..... B65D 5/70

[52] U.S. Cl. ..... 220/269; 220/359.2; 206/469; 229/123.2; 229/125.35

[58] Field of Search ..... 220/359, 270, 220/266, 265, 269, 268, 258, 257, 254, 256, 359.1, 359.2, 359.3, 359.4; 206/813, 812, 467, 469, 470; 383/78, 210, 211; 229/125.35, 123.3

[56] References Cited

U.S. PATENT DOCUMENTS

| | | | |
|---|---|---|---|
| 4,192,420 | 3/1980 | Worrell, Sr. et al. | 383/211 X |
| 4,197,949 | 4/1980 | Carlsson | 229/123.3 X |
| 4,260,061 | 4/1981 | Jacobs | 383/211 X |
| 4,491,224 | 1/1985 | Horvath | 229/125.35 X |
| 4,679,693 | 7/1987 | Forman . | |
| 4,705,197 | 11/1987 | Gordon et al. | 220/270 X |
| 4,735,335 | 4/1988 | Torterotot | 220/270 |
| 4,863,036 | 9/1989 | Heijenga | 229/125.35 X |
| 4,902,142 | 2/1990 | Lammert et al. | 383/78 |
| 4,946,038 | 8/1990 | Eaton | 229/125.35 X |
| 5,253,801 | 10/1993 | Bernstein et al. | 229/125.35 X |
| 5,655,661 | 8/1997 | Rigby | 229/125.35 X |

FOREIGN PATENT DOCUMENTS

| | | | |
|---|---|---|---|
| 0193130 | 9/1986 | European Pat. Off. . | |
| 0249337 | 12/1987 | European Pat. Off. . | |
| 367092 | 5/1990 | European Pat. Off. | 229/123.3 |
| 0488967A1 | 6/1992 | European Pat. Off. . | |
| WO86/06350 | 11/1986 | WIPO . | |

*Primary Examiner*—Stephen K. Cronin
*Assistant Examiner*—Nathan Newhouse
*Attorney, Agent, or Firm*—Birch, Stewart, Kolasch & Birch, LLP

[57] ABSTRACT

The present invention relates to a resealable container. The container includes a casing having a flap, which is openable to uncover an opening in the casing, and a covering foil, which covers and is attached to the flap and extends beyond this. The covering foil is resealably attached to the casing by a first adhesive force in a first area outside the flap and is substantially permanently attached to the casing by a second adhesive force greater than the first adhesive force, on the one hand in a basic area of the flap and, on the other hand, in a second area positioned outside the first area. According to the invention, the covering foil has only one perforated line between the first and second areas and is not attached to the casing in a third area within which the entire perforated line is extended.

10 Claims, 2 Drawing Sheets

RESEALABLE CONTAINER

The present invention relates to a resealable container having means for indicating whether the container is opened. More specifically, the present invention relates to a resealable container comprising a casing and a covering foil which is resealably attached thereto and has means for indicating whether the container has been opened.

BACKGROUND OF THE INVENTION

Many different resealable containers have been described in the literature. An important demand placed on these is that it must be easy to see whether the container has been opened. This is particularly important for resealable foodstuff containers, since an open container always yields reduced tightness and, thus, the risk of foreign microorganisms and the like entering the container.

Also for containers containing wet products, e.g. wipes, there is a need of visible proof that a container has been opened, since the liquid inside an open package evaporates more easily. In these containers, there may also be problems with undesired microorganisms if the container is intended for e.g. sterile compresses or the like.

U.S. Pat. No. 4,679,693 discloses a resealable container comprising a casing and a label having a pulling tab defined by two parallel perforated lines and intended for opening the container, a removed pulling tab indicating that the container has been opened. To secure the container against opening of the label from any other position than the one in which the pulling tab is located, either permanent adhesive or slits are arranged in the periphery of the label, such slits tearing if one tries to open the container. Inside the permanently attached periphery or inside the slits, there is a perforated line which defines an opening tab in the label.

EP-A1-0,249,337 discloses a resealable container having a releasably attached covering foil which has a pulling tab for opening the container. Also in this case, a removed pulling tab indicates that the container has been opened. To protect the container from being opened from a position other than the one in which the pulling tab is located, inclined cuts have been formed in the periphery of the covering foil. This causes the forming of small triangular portions in the periphery of the covering foil if one tries to open the container from these directions, which clearly proves that someone has opened or tampered with the container adjacent these cuts.

In many cases, the surface on which the label or covering foil is to be applied can be limited. Consequently, it can be difficult to accommodate the additional space required for a pulling tab. Moreover, it should be possible to uncover a sufficiently large opening in the container to reach the packed product, which entails that outside the opening of the container there is only a restricted surface on which the label or covering foil can be releasably attached. A drawback of the technique described above is that pulling tabs and cuts require too large a space on the casing.

SUMMARY OF THE INVENTION

Thus, the general object of the invention is to provide a container of the type discussed by way of introduction, that does not suffer from this drawback.

A specific object of the present invention is to provide a resealable container having a covering foil, which in a narrowly restricted area can indicate whether the container has been opened.

A further object of the present invention is to provide a container of the above-mentioned type, which is protected against any attempt to circumvent the tear indication.

These and other objects are achieved by means of a container according to claim 1. Particularly preferred embodiments are stated in the dependent claims.

Briefly, the present invention relates to a resealable container comprising a casing having a flap, which is openable to uncover an opening in the casing, and a covering foil, which covers and is attached to the flap and extends beyond this. The covering foil is resealably attached to the casing by a first adhesive force in a first area outside the flap and is substantially permanently attached to the casing by a second adhesive force which is greater than the first adhesive force, on the one hand in a basic area of the flap and, on the other hand, in a second area positioned outside the first area. According to the invention, the covering foil has only one perforated line between the first and second areas and is not attached to the casing in a third area, within which the entire perforated line is extended.

An advantage of the present invention is that it is possible to provide a resealable container which, in spite of a minimum area in which a covering foil is to be resealably attached, can present clear evidence whether the container has been opened.

The first time the container is opened, the single perforated line tears. When the container is then closed by reattaching the covering foil to the casing, the portions of the covering foil that are positioned on both sides of and immediately adjacent the torn perforated line, i.e. portions in said third area, will remain, slightly outwardly folded or bent away from the casing, caused by the first opening of the container. Due to the fact that said third area is not adhesive, one cannot adhere these portions to the casing in an attempt at concealing that the perforated line is torn.

Preferred embodiments of the invention will now be described with reference to the accompanying drawings. These embodiments must not be considered to restrict the scope of the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
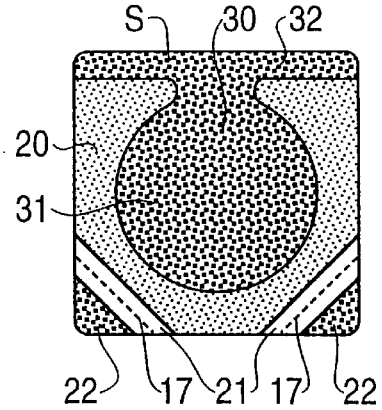
FIGS. 1–7 illustrate different embodiments of how, according to the present invention, areas having different degrees of adhesion and non-adhesive areas with perforated lines extending in these areas can be arranged on the covering foil side that faces a casing.

According to the invention, the casing of the container can be designed in various ways. The container in FIGS. 8–10, generally designated 1, is of the type having a casing 11 consisting of a relatively rigid, cup-shaped flanged lower part 12 and a flat upper part 13 which is permanently attached to the flange and has a non-closed perforated line 15, alternatively an all-punched line, which defines an openable flap 14 for reaching the interior of the container. The container 1 further comprises a covering foil or label 16, which is attached on top of the upper part 13 and is intended to be opened, as shown in FIG. 9, together with the flap 14, thereby making it possible to reach the interior of the container. It should be noted that the planar flange of the lower part 12 preferably is elastically resilient for reasons that will be discussed below. The perforation 15 is torn during the first opening of the container 1, since the covering foil 16, which is substantially permanently attached to the flap 14, entrains the latter during the opening of the container.

The casing of the container can be designed as a so-called flow-pack of the type illustrated and disclosed in, for instance, EP-A2-0,193,130 and PCT/DE86/00176.

Figure 8:
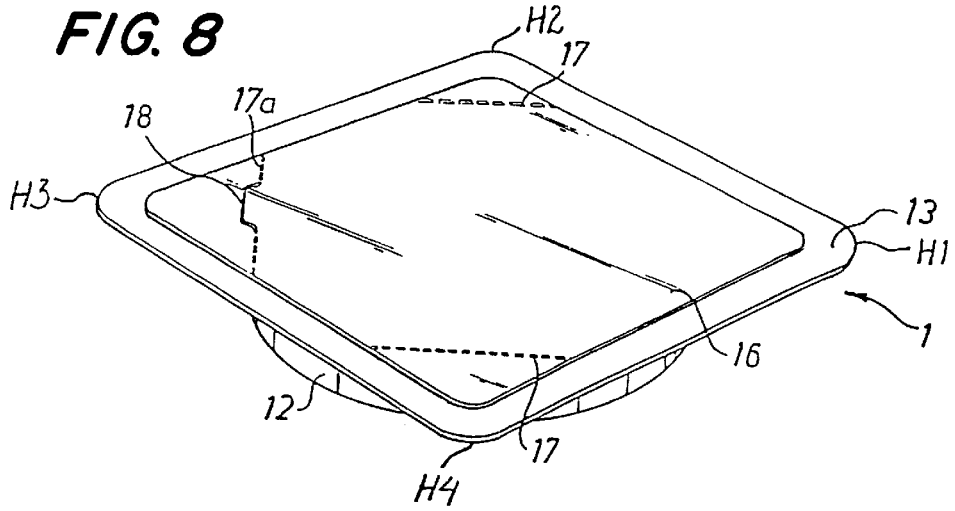
FIG. 8 is a perspective view of a preferred embodiment of an unopened container according to the present invention, provided with a covering foil according to FIG. 4.
Figure 9:
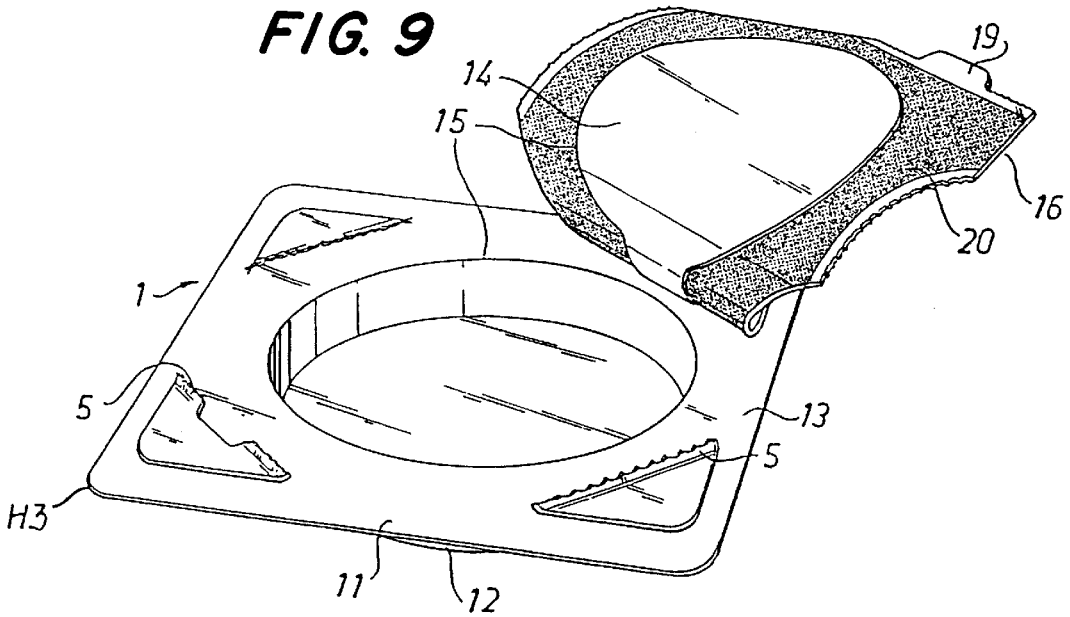
FIG. 9 shows the container in FIG. 8 in its completely open state.
Figure 10:
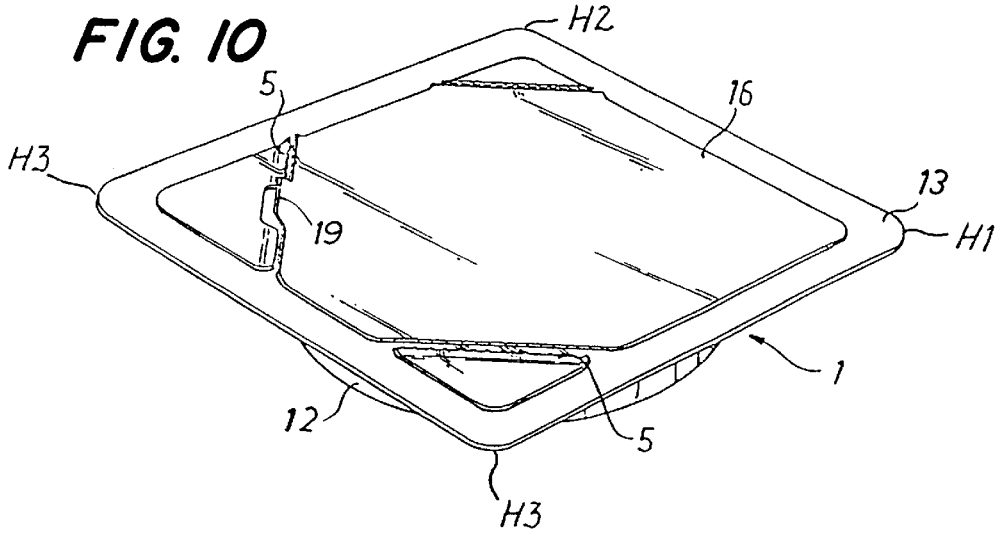
FIG. 10 shows the container in FIG. 9 in its resealed state; it is quite obvious that the container has been opened.

Reference is now made to FIGS. 1–7, which schematically illustrate different variants of covering foils usable as the covering foil 16 in FIGS. 8–10. The covering foil in FIGS. 8–10 corresponds to the variant in FIG. 4.

In FIGS. 1–7, which illustrate different areas having different degrees of adhesion and non-adhesive areas on the side of the covering foil 16 which faces the casing 11, the dark screening designates areas having substantially permanent adhesion to the casing, the bright screening designates areas having resealable adhesion, i.e. weaker adhesion, and unfilled areas designate no adhesion between the covering foil and the casing. The dashed lines indicate perforated lines, and a full line indicates an all-punched line.

In all the embodiments, the covering foil 16 having a first area made up of a plurality of sub-areas is resealably attached to the casing 11 by a first adhesive force in a first sub-area 20 outside the flap 14 and is substantially permanently attached to the casing 11 by a second, relatively greater adhesive force, on the one hand in a second sub-area 30 of the flap 14 and, on the other hand, in one or more second sub-areas 22 positioned outside the first area 20. Between the first and second sub-areas 20, 22, the covering foil 16 has, according to the invention, only one perforated line 17, which is torn during the first opening of the container 1. Moreover, the covering foil 16 is not attached to the casing 11 in a third sub-area 21, within which the entire perforated line 17 is extended and which is arranged between said first and second sub-areas 20, 22.

The covering foil 16 can be substantially permanently attached to the casing 11 in a plurality of spaced-apart second sub-areas 22, which are distributed outside and round the first sub-area 20 and adjacent a pertaining third sub-area 21. The covering foil 16 has a perforated line 17 in each third sub-area 21.

If the covering foil 16 is rectangular, preferably at least two of said plurality of second sub-areas 22 are each positioned in a corner of the covering foil 16.

Figure 2:
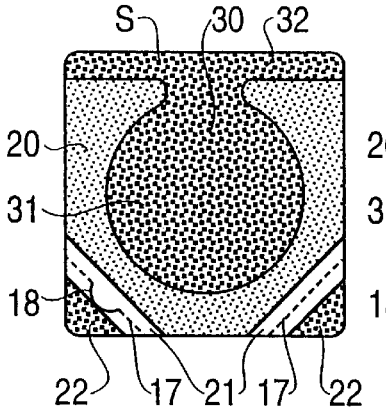
Figure 3:
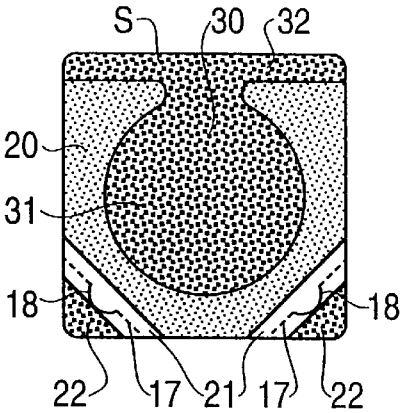

As is evident from FIGS. 1–7, the covering foil 16 preferably is substantially permanently attached to the entire flap 14, and this area 31 having substantially permanent adhesion passes continuously into the basic area 30 of the flap 14. If the flap 14, as shown in FIGS. 1–3 as well as 6 and 7, is extended perpendicularly from a side edge S of the covering foil 16, the basic area 30 of the flap 14 can pass into an area 32, which is extended along the entire or substantially entire length of said side edge S.

Figure 4:
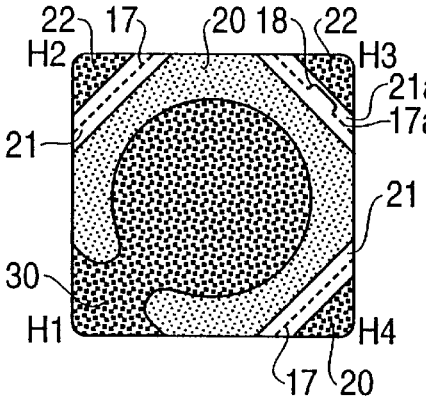
Figure 5:
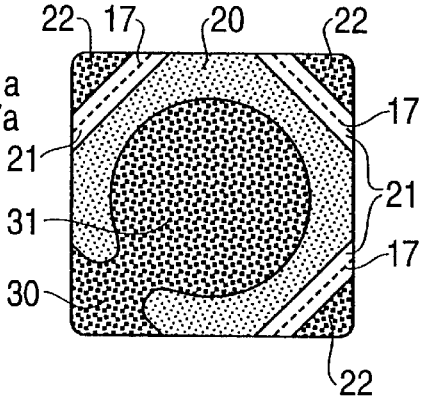
Figure 6:
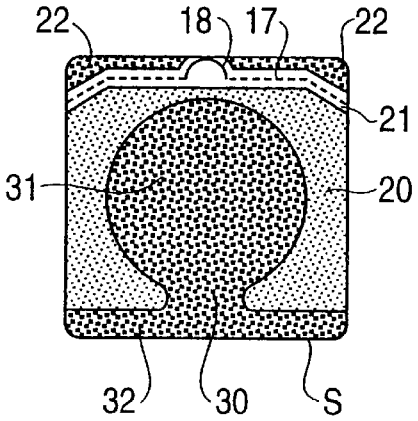
Figure 7:
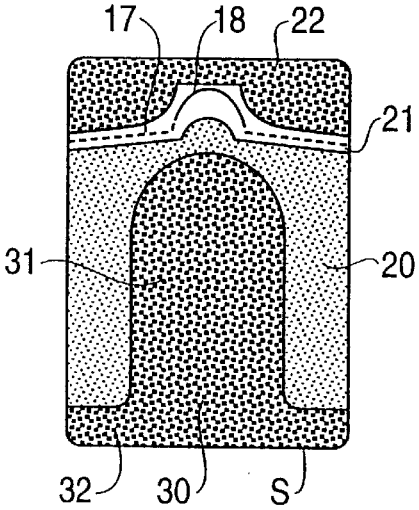

The flap 14 can further be extended from its basic area 30 in the direction of an opposite corner H3 of the covering foil 16, as shown in FIGS. 4 and 5. The basic area 30 of the flap 14 can, thus, also comprise a corner H1 from which the flap 14 is extended.

Reference is now made to the container 1 in FIGS. 8–10, which, as mentioned above, has a covering foil 16 according to FIG. 4. The covering foil 16 is resealably attached to the casing 11 by a first adhesive force in a first sub-area 20 outside the flap 14 and is substantially permanently attached to the casing 11 on the one hand in all corners H1, H2, H3, H4 of the covering foil 16 and, on the other hand, adjacent the flap 14, whereby the covering foil 16 is continuously permanently attached to the casing 11 in the flap 14 and in that corner H1 of the covering foil 16 from which the flap 14 is extended. In the remaining corners H2, H3, H4 are third sub-areas 21 of the above-mentioned type, which have no adhesion between the casing 11 and the covering foil 16. Only one perforated line 17 is extended in each third sub-area 21. The perforated line designated 17*a,* which extends within the third sub-area 21*a* adjoining that corner H3 towards which the flap 14 is extended, includes an all-punched line 18. The line 18 is, like the rest of the perforated line 17*a,* completely extended within said third area 21*a* and defines a gripping tab 19 for opening the container 1.

In FIG. 10, the container 1 is resealed after being opened as illustrated in FIG. 9, and the fact that the container 1 has been opened is obvious because of the upwardly bent edges 5 formed at the three perforated lines 17*a,* 17. The covering foil 16 is formed of such a material that it gets such a permanent deflection from the casing 11 when the container 1 is opened the first time, and these portions are initially raised from the casing 11 before the perforated lines 17*a,* 17 tear. Since there is no adhesion in said third sub-areas 21*a,* 21, within which the perforated lines 17*a,* 17 are extended, the upwardly bent edges 5 as formed cannot be pressed back to make the container 1 look as if it had not been opened.

It should be noted that the gripping tab defined by the line 18 can be excluded, thereby instead making it possible to open the container by bending down the corner where one intends to open the container, thus tearing the corresponding perforated line. Since the covering foil 16 has no adhesion in a third sub-area 21 between the perforated line 17 and the first sub-area 20, this part of the covering foil 16 can constitute a gripping tab for opening the container.

Since the perforated lines 17*a,* 17 and said third sub-areas 21*a,* 21, respectively, are so extended as to open into the circumferential edge of the covering foil 16, the perforations 17*a,* 17 are torn when an attempt is made to open the container 1 between the permanently attached areas, for instance between the corners H3 and H4 in FIG. 4.

We claim:

1. A resealable container comprising:

a covering foil with a first area, said first area being divided into a plurality of sub-areas;

a casing having a flap with a second area, said second area of said flap covering an opening of said casing in a closed condition, said first area being substantially larger than said second area, said flap being attached to said covering foil and being disposed between said casing and said covering foil, said casing further including a cup-shaped volume which has an end wall with a third area, said third area substantially corresponds with said second area, said casing further including a substantially planar surface with a fourth area surrounding said opening, said first area being substantially larger than said fourth area;

a first adhesive being disposed on said planar surface between said foil and said casing, said first adhesive being disposed in a first sub-area outside of said opening and having a first adhesive force, said covering foil being resealably attached to said casing by said first adhesive in said first sub-area;

a second adhesive being disposed on said planar surface between said foil and said casing, said second adhesive being disposed in a second sub-area outside of said opening and outside of said first adhesive, said second adhesive having a second adhesive force which is substantially greater than said first adhesive force, said covering foil being substantially permanently attached to said casing by said second adhesive, said second-sub area is substantially separated from said flap when said flap is in an open condition; and a perforation being disposed in said covering foil and in a third sub-area located between said first and second sub-areas, said third sub-area not including any adhesives, said third sub-area separating said first adhesive from said second adhesive, said covering foil being deflected permanently to form bent edges along said perforation which project in a direction away from said casing when said covering foil is first opened, whereby said edges provide a substantially permanent indicator that said covering foil has been opened.

2. The container as claimed in claim 1, wherein the second sub-area is a plurality of spaced-apart second sub-areas, which are positioned outside and distributed around said first sub-area and said third sub-area covering foil 16 having a first area made up of a plurality of sub-areas, the covering foil having a perforated line in each third sub-area.

3. The container as claimed in claim 2, wherein the covering foil is substantially rectangular, and that at least two of said plurality of second sub-areas are each positioned in a corner of the covering foil.

4. The container as claimed in claim 3, wherein the flap of the casing is oriented in a direction of an opposite side edge of the covering foil, and said corners of the covering foil are corners of said side edge.

5. The container as claimed in claim 4, wherein the second sub-area, in which the covering foil is substantially permanently attached to the casing, includes an area which extends substantially an entire length of a side edge of the covering foil, the flap being oriented from said side edge.

6. The container as claimed in claim 3, wherein the flap of the casing is oriented from said second sub-area in the direction of an opposite corner of the covering foil.

7. The container as claimed in claim 6, wherein the flap includes a corner of the covering foil, the flap being extended from said corner.

8. The container as claimed in claim 1, wherein the perforation in the covering foil includes an all-punched line, which is also extended within said third sub-area and defines a tab for opening the container.

9. The container as claimed in claim 1, wherein the covering foil is substantially permanently attached to the flap.

10. The container as claimed in claim 1, wherein the flap of the casing is defined by a second perforation which is torn when the container is opened for a first time.

* * * * *